US007374496B2

(12) United States Patent
Grant et al.

(10) Patent No.: US 7,374,496 B2
(45) Date of Patent: May 20, 2008

(54) GOLF CLUB, BALL, REEL AND LINE APPARATUS

(76) Inventors: Marlin D. Grant, 3334 Shepherd Hills Dr., Bloomington, MN (US) 55431; Marlan D. Carlson, 5349 Dominick Dr., Minnetonka, MN (US) 55343

( * ) Notice: Subject to any disclaimer, the term of this patent is extended or adjusted under 35 U.S.C. 154(b) by 561 days.

(21) Appl. No.: 10/682,677

(22) Filed: Oct. 9, 2003

(65) Prior Publication Data

US 2005/0079920 A1 Apr. 14, 2005

(51) Int. Cl.
*A63B 69/36* (2006.01)

(52) U.S. Cl. ..... 473/138; 473/142; 473/147

(58) Field of Classification Search ..... 473/138, 473/139, 142, 147, 219, 226, 229, 422, 423, 473/424, 430, 506, 575
See application file for complete search history.

(56) References Cited

U.S. PATENT DOCUMENTS 1,326,976 A * 1/1920 Schnurr ..... 473/147
2,852,261 A * 9/1958 Meminger ..... 473/147
2,941,805 A * 6/1960 Chupa ..... 473/575
3,065,563 A * 11/1962 Bascom ..... 43/19
3,086,242 A 4/1963 Cook et al.
3,988,399 A 10/1976 Evans
4,192,044 A * 3/1980 Ballerini ..... 24/607
4,384,719 A 5/1983 Schmanski
4,526,374 A 7/1985 Ban
4,733,868 A 3/1988 Seiden
5,470,622 A 11/1995 Rinde et al.
5,573,850 A 11/1996 Cunningham et al.
5,599,238 A * 2/1997 Roderick ..... 473/147
5,662,527 A 9/1997 Jacquinot et al.
5,743,812 A 4/1998 Card
5,753,366 A 5/1998 Koike
5,853,334 A * 12/1998 Winebrenner ..... 473/142
5,855,332 A 1/1999 Stiner
5,881,492 A 3/1999 Abiru et al.
6,375,107 B1 4/2002 Wong
6,497,626 B1 12/2002 Sundberg
6,561,921 B2 5/2003 Takeda
6,608,127 B1 8/2003 Kato et al.
6,616,551 B2 9/2003 Nesbitt et al.
6,620,061 B1 9/2003 Ichikawa et al.
2003/0144065 A1 7/2003 Palmer

FOREIGN PATENT DOCUMENTS

GB 2108855 A * 5/1983

OTHER PUBLICATIONS

Gemmy Industries Corp., "No More Chasing Down Golf Balls!", 2001, Gemmy Industries Corp., Irving, TX 75038 U.S.A.

* cited by examiner

*Primary Examiner*—Raleigh W. Chiu

(57) ABSTRACT

The apparatus includes a fishing reel set fast upon a golf club with shrink wrap engaging feet of a base of the reel. An eyelet is also engaged fast upon the golf club with the shrink wrap. Fishing line extends from the reel to and through the eyelet. A golf ball is attached to the end of the fishing line via a rivet frictionally engaging an opening in the golf ball. The rivet includes a catch to keep the rivet in the golf ball and to keep the line in the rivet. The rivet further includes a head having an arced surface following the arced surface of the golf ball.

15 Claims, 5 Drawing Sheets

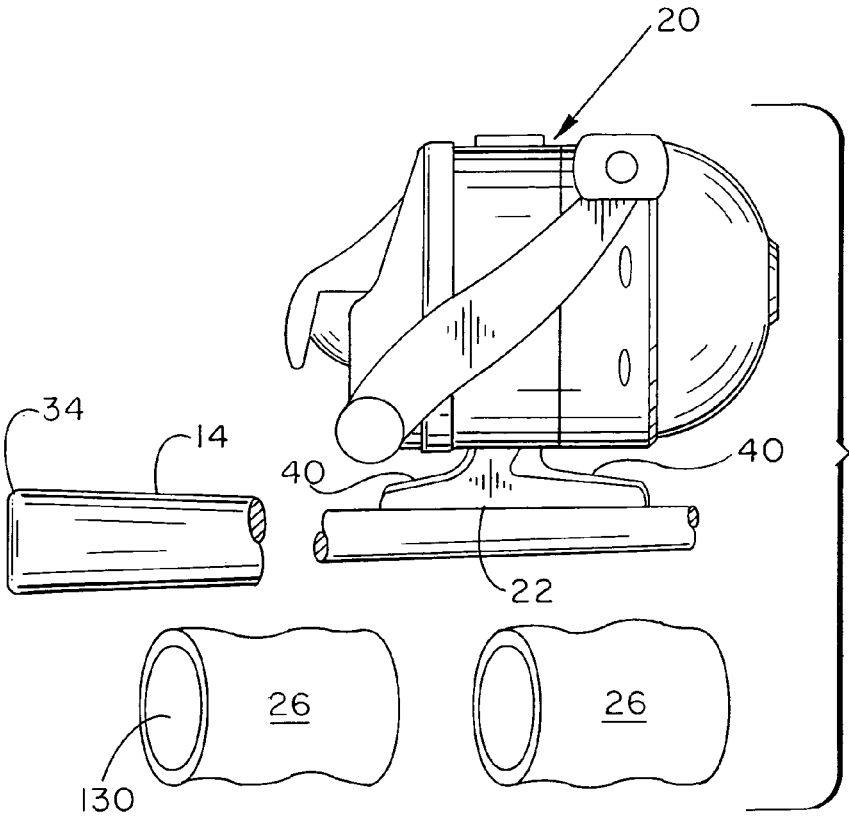
Fig.-4A
Fig.-4B
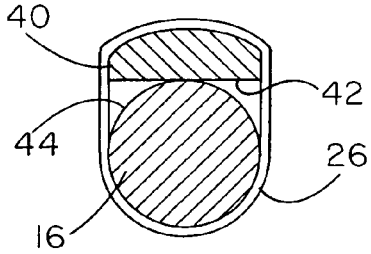
Fig.-4C
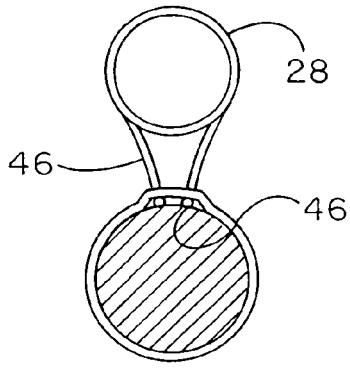

GOLF CLUB, BALL, REEL AND LINE APPARATUS

FIELD OF THE INVENTION

The present invention relates generally to golf apparatus, particularly to a combination of golf and fishing apparatus, and specifically to means for fixing a reel on a golf club and a fishing line on a golf ball.

BACKGROUND OF THE INVENTION

Golfers and distractions are the antithesis of two peas in a pod. Concentration is the name of the game and concentration is difficult when one swings the putter and a fishing reel rattles or when one realizes in the midst of one's swing that the head of the putter may hit the golf ball exactly where the fishing line has been attached.

Fishing reels rattle when golfers use prior art apparatus that poorly mount the fishing reel to the golf club. A conventional fishing reel has a base or mount that has a flat underside. The flat underside engages a flat receptor on the conventional fishing rod. However, the conventional golf club has no such flat receptor, but instead usually includes a handle and shaft that have cylindrical outer surfaces or a frustoconical outer surfaces. Such a round surface of the shaft or handle interacts poorly with a flat underside because these two surfaces tend to pivot relative to each other upon making contact.

Fishing line may be attached to the golf ball at one or more locations. When attached at two or more locations, the chances are maximized that the putting club head hits the ball where the line is attached to the ball. This is undesirable. When attached at two or more locations, it may be no longer convenient to play the game because one must bend down to reposition the ball prior to putting so that the attachment location is out of the way. Even when attached at one location, and even if one carefully and slowly reels in the ball so that the attachment location is momentarily out of the way and so that it appears that the head of the putter will make contact with an original and unaltered location on the dimpled surface of the golf ball, chances are high that the attachment location will roll to the wrong spot.

SUMMARY OF THE INVENTION

A feature of the present invention is the provision in a golf club and reel combination, of the base of the reel being fixed fast to the golf club with a one-piece and integral band.

Another feature of the present invention is the provision in a golf club and reel combination, of the base of the reel being fixed fast to the golf club with a one-piece and integral band where the one-piece and integral band has been shrunk under heat to be wrapped tightly about the reel and the golf club, thereby fixing the reel securely to the golf club with a minimum of movement therebetween.

Another feature of the present invention is the provision in a golf club and reel combination, of the base of the reel being an inverted T-mount with two feet, wherein each of the feet is fixed fast upon the golf club with a one-piece and integral band.

Another feature of the present invention is the provision in a golf club and reel combination, of the base of the reel being fixed fast to the golf club with a one-piece and integral band, with the one-piece and integral band being heat shrunk in one embodiment (with heat recoverable compositions), or heat expandable in another embodiment (with thermoplastic compositions).

Another feature of the present invention is the provision in a golf ball and fishing line combination, of a snap rivet (hereinafter referred to as rivet) being engaged in an opening formed in the golf ball and of the fishing line being engaged between the rivet and the golf ball, where the rivet has an outside surface having a radius identical to or close to the radius of the golf ball.

Another feature of the present invention is the provision in a golf ball and fishing line combination, of a rivet being engaged in an opening formed in the golf ball and of the fishing line being engaged between the rivet and the golf ball, where the rivet is removable from the golf ball such that fishing line may be easily engaged to and disengaged from the golf ball.

Another feature of the present invention is the provision in a golf ball and fishing line combination, of a rivet being engaged in an opening formed in the golf ball and of the fishing line being engaged between the rivet and the golf ball, where the plug includes a catch to create resistance to an attempt to pull the rivet from the golf ball.

Another feature of the present invention is the provision in a golf ball and fishing line combination, of a rivet being engaged in a lined opening bonded in the golf ball and of the fishing line being engaged between the rivet and the golf ball, where the rivet is removable from the golf ball such that fishing line may be easily engaged to and disengaged from the golf ball and such that the interaction between the rivet and the liner is controlled.

Another feature of the present invention is the provision in a golf ball and fishing line combination, of a rivet being engaged in an opening in the golf ball and of the fishing line being engaged between the rivet and the golf ball, where the rivet includes two opposing prongs with a slot there between such that fishing line can be pulled up into the slot, such that fishing line can be wrapped about one or both of the prongs, and such that the prongs can be squeezed together to provide a friction fit with the opening in the golf ball.

Another feature of the present invention is the provision in a golf ball and fishing line combination, of a rivet being engaged in an opening in the golf ball and of the fishing line being engaged between the rivet and the golf ball, where the rivet includes a row of fins or pinchers that are compressed when the rivet is inserted into the opening, thereby pinching a fishing line wrapped about a shaft of the rivet, with the fins doubling as locks that provide resistance when an attempt is made to remove the rivet from the golf ball.

Another feature of the present invention is a tool for removing the locked in rivet from the golf ball.

An advantage of the present invention is silence. The reel is well mounted to the golf club. No noise is created with the golf club is swung.

Another advantage of the present invention is that a fishing reel is quickly and securely mounted to the golf club with a hot air gun that shrinks the one-piece and integral bands about the T-mount of the fishing reel.

Another advantage of the present invention is convenience. Since the fishing line is attached to the golf ball at only one location, stooping is minimized to reposition the ball that has been reeled in. Further, the removable rivet makes it easy and convenient to attach and reattach a fishing line to the golf ball.

Another advantage of the present invention is cost savings for the manufacturer. A manufacturer of the present invention can use a conventional reel having a flat base and does not need to supply another base for a particular style of golf club, of which there are thousands.

IN THE DRAWINGS

FIG. 4A is a side view showing components of the present invention and in particular shows the one-piece and integral bands prior to being shrunk and of a size sufficient for slipping over the handle and then over the feet of the base of the reel.

FIG. 4B is a section view of FIG. 1 and shows the one-piece and integral band shrunk tightly over the flat base and round shaft.

FIG. 4C is a section view of FIG. 1 and shows the one-piece and integral band shrunk tightly over the base of the eyelet.

DESCRIPTION OF THE PREFERED EMBODIMENT

Figure 1:
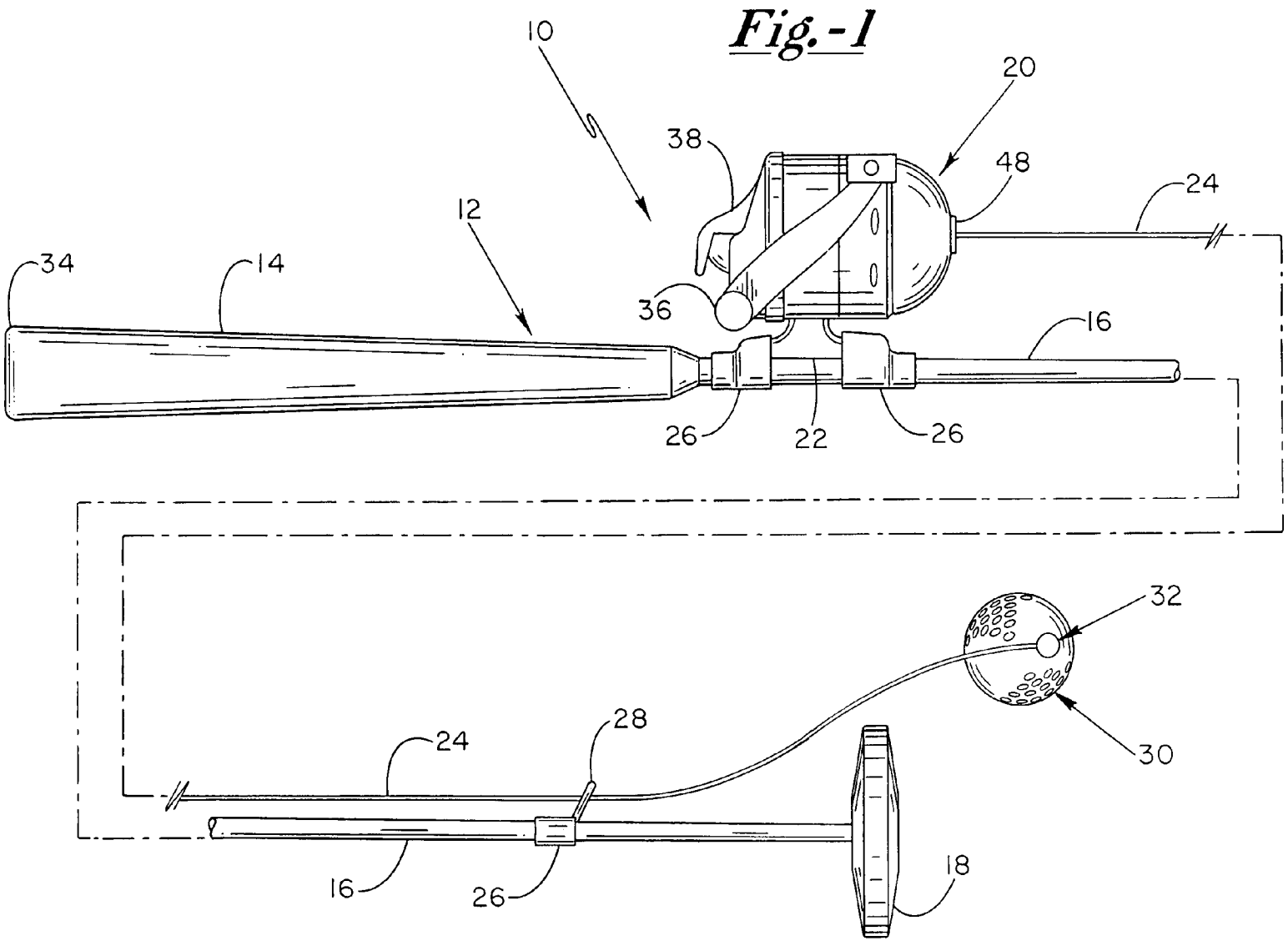
FIG. 1 is a side view of the present invention showing a golf club, a fishing reel mounted to the golf club with two one-piece and integral bands, eyelet mounted to the golf club with one one-piece and integral band, a golf ball having a rivet, and fishing line extending from the fishing reel, through the eyelet, and to the rivet of the golf ball.
Figure 2B:
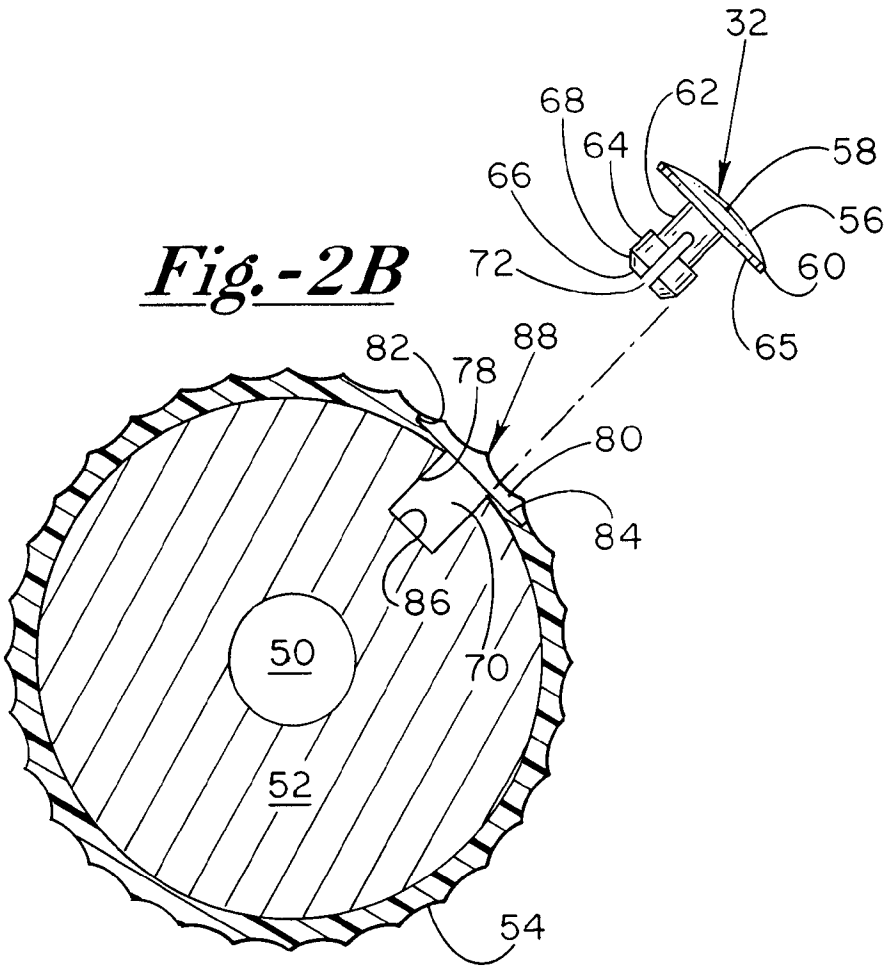
FIG. 2B is a section view of the golf ball of FIG. 2A and shows a side view of the rivet.
Figure 2A:
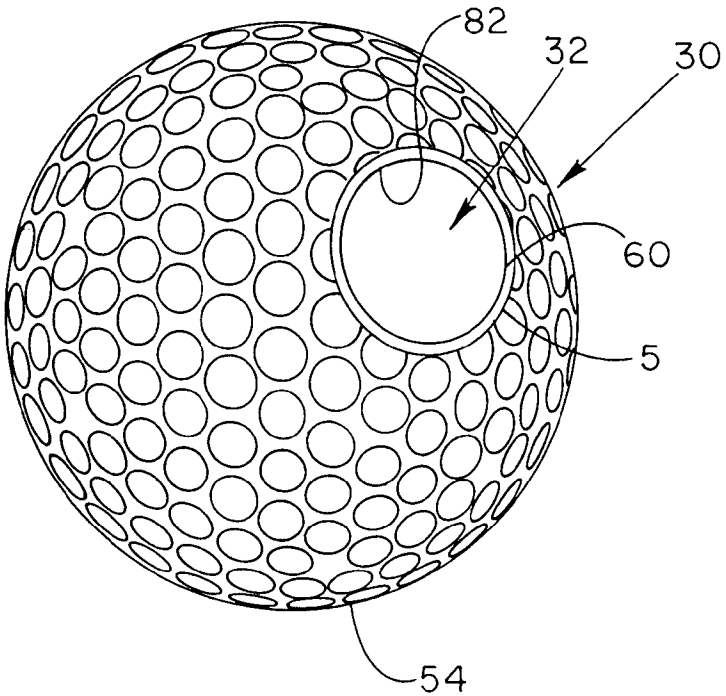
FIG. 2A is a detailed perspective view of the golf ball having the rivet.

As shown in FIG. 1, the present apparatus is indicated in general by the reference number 10. Apparatus 10 includes a golf club 12 having a handle 14, shaft 16 and club head 18, a fishing reel 20 having an inverted T-base 22 and fishing line 24 extending therefrom, a pair of one-piece and integral bands 26 shrunk about the feet of the T-base 22, an eyelet 28 fixed to the shaft 16 with a third one-piece and integral band 26, and a golf ball 30 with a rivet 32 for fixing the fishing line 24 to the golf ball 30.

The golf club 12 is preferably a putter, chipping or pitching wedge iron that adheres to the Rules of Golf as set forth by the United States Golf Association (USGA) and The Royal and Ancient Golf Club of Saint Andrews (R & A). To the extent permitted, these Rules of Golf are hereby incorporated by reference. The golf club 12 is more preferably a putter.

As to a putter, the Sundberg U.S. Pat. No. 6,497,626 B1 issued Dec. 24, 2002, entitled Golf Putter, and assigned to Leif Sundberg Golf AB is hereby incorporated by reference.

As to a iron, the Takeda U.S. Pat. No. 6,561,921 B2 issued May 13, 2003, entitled Iron Golf Club, and assigned to K. K. Endo Seisakusho is hereby incorporated by reference.

As to a driver, the Card U.S. Pat. No. 5,743,812 issued Apr. 28, 1998, entitled Golf Driver And Method Of Making Same, and assigned to MasterGrip, Inc. is hereby incorporated by reference.

More particularly, the golf club 12 includes a proximal end portion and a distal end. The proximal end portion includes the handle or grip 14 and the distal end includes the head 18 for striking the golf ball 30. Between the proximal end portion and the distal end is the shaft 16. Handle or grip 14 is tapered.

It should be noted that the reel 20 may be located at a variety of locations on the golf club 12. For example, the reel 20 may be located on the proximal end of the golf club 12 and be situated only on the handle 14. Or the reel 20 may be located partially on the handle 14 and partially on the shaft 16. Or the reel 20 may be located exclusively on the shaft 16. Or the reel 20 may be located partially on the shaft 16 and partially on the head 18. Or the reel 20 may be located exclusively on the head 18 of the golf club 12. It should be noted that some golf clubs have heads that are formed of one-piece and narrow or taper into the shaft such that some heads have shaft portions that are one-piece with the portion of the head that strikes the golf ball. Hence the feet of the base 22 of the reel 20 may engage one or more of the handle 14, shaft 16 and head 18 of the golf club 12. Accordingly, the one-piece and integral band 26 may engage one or more of the handle 14, shaft 16 and head 18 of the golf club 12.

The reel 20 includes a handle 36 that is rotated, a spool operated by the handle 36, a button 38 for unlocking and locking the spool, and the base 22 for engagement of the reel 20 to the golf club 12. The reel 20 is preferably a fishing reel. As to fishing reels and their components such as spools, the following U.S. Patents are hereby incorporated by reference: 1) the Stiner U.S. Pat. No. 5,855,332 issued Jan. 5, 1999, entitled Rotatable Line Spool For A Fishing Reel, and assigned to Zebco Corporation; and 2) the Wong U.S. Pat. No. 6,375,107 B1 issued Apr. 23, 2002, entitled Spincast Fishing Reel, and assigned to Shakespeare Company.

Base 22 of reel 20 includes a pair of feet 40, which are shown in FIG. 4A and one of which is shown in FIG. 4B. As shown in FIG. 4B, foot 40 includes a flat underside 42, a feature that contributes to a pivoting of the flat underside 42 relative to a round surface 44 of the shaft 16. By using the heat shrinkable one-piece and integral band or tube 26, the tightness of the heat shrunk band 26 keeps the reel 20 fixed fast to the shaft 16 with a minimum amount or no movement between the feet 40 and the shaft 16. Further, the friction of the rubber or elastomeric or thermoplastic band 26 keeps the band 26 itself from slipping or rotating about the shaft 16 and feet 40. Yet further, the inside of the band or tubing 26 preferably includes an adhesive 130. Still further, the band or shrink wrap or tube 26 conforms to the shape of the base 22, which may be irregular, squared off, or rounded or some other shape.

The one-piece and integral band 26 is annular and endless, as shown in FIG. 4A. The one-piece and integral band 26 is preferably a heat-recoverable article and more preferably a heat-recoverable article with a thermosetting adhesive 130 on its inner face where the tube or band 26 makes contact with the substrate. One-piece and integral bands 26 have a size sufficiently large to as to easily slip over the feet of the T-base 22 and have a size sufficiently small so as to, when heat shrunk, tightly wrap about the feet of the T-base 22 and the shaft 16 of the golf club 12.

The tube or band 26 may be heat shrunk with a hot air gun commonly known as a paint stripper. Further, the tube or band 26 may be heat shrunk by passing an electrical current therethrough.

It should be noted that tubes or bands 26 preferably have the adhesive 130 on the inner annular face. As to such adhesive and as to such shrink wrap tubes or bands 26, the Rinde et al. U.S. Pat. No. 5,470,622 issued Nov. 28, 1995, entitled Enclosing A Substrate With A Heat-Recoverable Article, and assigned to Raychem Corporation, is hereby incorporated by reference in its entirety.

It should be noted that shrink wrap piece 26 is not restricted to a tubular configuration. Please see the Evans U.S. Pat. No. 3,988,399 issued Oct. 26, 1976, entitled Heat Recoverable Articles And Methods Therefor, and assigned to Raychem Corporation, which is hereby incorporated by reference in its entirety.

Further as to shrink wrap piece 26, the Cook et al. U.S. Pat. No. 3,086,242 issued Apr. 23, 1963, entitled Process And Apparatus For Producing Materials Having Plastic Memory, and assigned to Raychem Corporation, is hereby incorporated by reference in its entirety.

Shrink wrap 26 preferably includes an inside diameter of between about one-half of an inch to about three-quarters of an inch prior to being heated and an inside diameter of between about one-quarter of an inch to about three-eighths of an inch after being shrunk.

A conventional elastomer is a natural or synthetic polymer which at room temperature can be stretched repeatedly to at least twice its original length and which after removal of the tensile load will immediately and forcibly return to, approximately, its original length. The glass transition temperature of a typical elastomer is well below room temperature such that the elastomer is soft, flexible, and resilient at room temperature. The processing of elastomers is relatively slow, is irreversible, and requires heat to change from a processible melt to a rubber like object.

A thermoplastic is a plastic material with a glass-rubber transition temperature well above room temperature such that the thermoplastic is relatively hard at room temperature. A thermoplastic material softens on heating and hardens on cooling, with the heating/cooling cycle being rapid and repeatable. Unlike conventional elastomers, a thermoplastic changes from a processible melt to a solid object upon cooling. A thermoplastic elastomer displays the typical high elasticity of an elastomer, but may be processed as a thermoplastic. Thermoplastic elastomers, instead of being cross-linked through covalent bonds by vulcanization like conventional elastomers, have their polymer chains tied together by physical crosslinks. These physical crosslinks are broken by heating and reformed upon cooling.

In an alternative embodiment of the invention, the band 26 may be formed from a thermoplastic elastomer and heated prior to being inserted onto the shaft 16. The band 26 can be heated such as with a household blow drier, slipped over the end 34 of the handle 14 (or over the distal end, with or without the club head removed) and over the feet 40 and shaft 16, and permitted to cool. Then the end user can try out his or her putter and try out the sight line provided by the position of the reel 20. If the sight line is not desired, the bands 26 may be heated and loosened, the position of the reel 20 changed, and the bands 26 may be allowed to cool. Then, when the end user takes his or her putter out to the golf course for actual use, the bands 26 may be heated and slipped off the feet 40 and handle end 34, and the fishing reel 20 removed.

Eyelet 28 includes a base 46, a portion of which lies on the shaft 16 and is engaged by the one-piece and integral band 26. Like with reel 20, eyelet 28 is an after-market piece. Eyelet 28 is first glued to the shaft 16 at the desired position and then the band 26 is slipped onto the base 46 of the eyelet 28. Then the tube or band 26 is heat shrunk such that the eyelet 28 is fixed fast to the shaft 16. Like with reel 20, eyelet 28 can be positioned solely on the handle 14, partially on the handle 14 and partially on the shaft 16, solely on the shaft 16, partially on the shaft 16 and partially on the club head 18, or solely on the club head 18. Further, the eyelet 28 and reel 20 can be positioned relatively closely together or relatively far apart. Still further, the eyelet 28 is preferred to be located somewhere on the golf club 12, but may if desired be left off the golf club 12. Eyelet 28 is not required for operation of the present invention. Eyelet 28 is generally on the same side of the shaft 16 as a spool opening 48. Specifically, the eyelet is adjusted such that the center of the eyelet 28 is set on a line between the center of the spool opening 48 and a point in front of the front center of the face of the putting head 18. This point is about the length of a radius of golf ball 30 in front of the front center face of the putting head 18. When set on such a line, the line 24 can be wound up to retrieve the ball 30 and then, upon full retrieval, the plug 32 is located at a top portion of the ball 30, out-of-the-way of the putting head 18, whereupon the lock 38 can be pressed to release the line 24 and whereupon the putting stroke can begin.

Golf ball 30 may include a core 50, an inner layer or second core 52 and an outer layer or cover 54. As to golf ball 30 and the components and features of a golf ball, the following U.S. Patents are hereby incorporated by reference: 1) the Ichikawa et al. U.S. Pat. No. 6,620,061 B1 issued Sep. 16, 2003, entitled Golf Ball, and assigned to Bridgestone Sports Co., Ltd.; 2) the Nesbitt et al. U.S. Pat. No. 6,616,551 B2 issued Sep. 9, 2003, entitled Golf Ball, and assigned to The Top-Flite Golf Company; and 3) the Kato et al. U.S. Pat. No. 6,608,127 B1 issued Aug. 19, 2003, entitled Golf Ball, and assigned to Sumitomo Rubber Industries, Ltd.

Golf ball 30 is preferably a ball that adheres to the Rules Of Golf as set forth by the United States Golf Association (USGA) and The Royal and Ancient Golf Club of Saint Andrews (R&A). For example, as set forth in Appendix III of the Rules of Golf, the weight of the ball shall not be greater than 1.620 ounces avoirdupois (45.93 gm), the diameter of the ball shall be not less than 1.680 inches (42.67 mm) which is satisfied if, under its own weight, a ball falls through a 1.680 inches diameter ring gauge in fewer than 25 out of 100 randomly selected positions, the test being carried out at a temperature of 23.+−.1.degree. C., and the ball must not be designed, manufactured or intentionally modified to have properties which differ from those of a spherically symmetrical ball. Also, the Rules of Golf limit the initial velocity of a golf ball to 250 feet (76.2 m) per second (a two percent maximum tolerance allows for an initial velocity of 255 per second) and the overall distance to 280 yards (256 m) plus a six percent tolerance for a total distance of 296.8 yards (the six percent tolerance may be lowered to four percent). A complete description of the Rules of Golf is available on the USGA web page at www.usga.org/ or at the R & A web page at www.randa.org/.

Figure 3B:
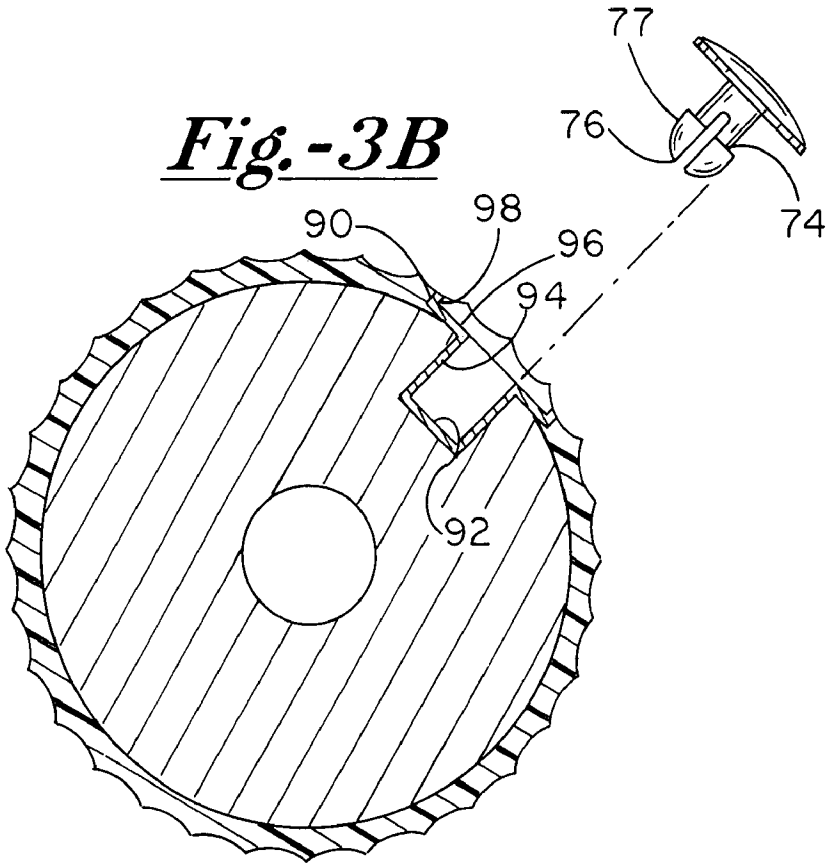
FIG. 3B is a section view of the golf ball of FIG. 3A, shows a side view of the rivet, and shows the lining in the golf ball for the rivet.
Figure 3A:
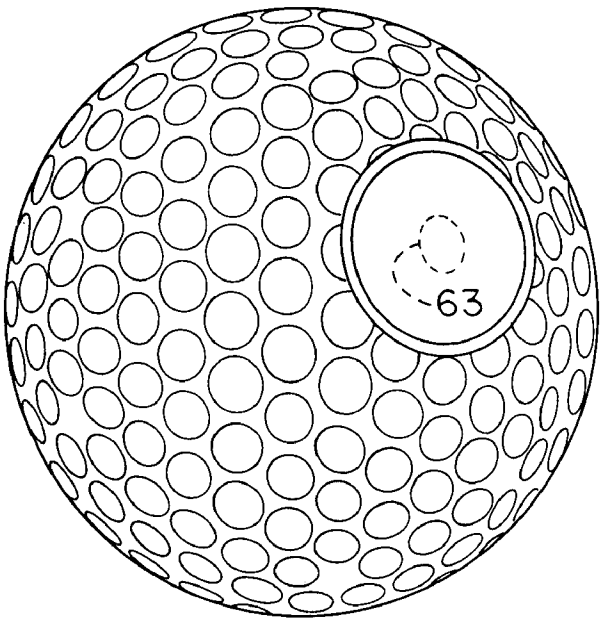
FIG. 3A is a detailed perspective view of another embodiment of the golf ball and rivet where the opening in the golf ball for the rivet is lined.

Plug 32 includes a head 56 having a hemispherical surface 58. Head 56 includes a first perimeter 60. Rivet 32 further includes a pair of prongs or a pincher or pinching mechanism 62 integral with the head 56 and depending from a central portion 63 (shown in phantom in FIG. 3A) of an underside 65 of the head 56. Each of the prongs 62 includes a barb or lock 64 spaced from a respective end 66 of the respective prong 62. A tapered portion 68 is formed between the end 66 and the barb 64 such that the prongs 62 can be guided easily into narrow opening 70 formed in golf ball 30. The prongs 62 form a slot 72 therebetween to permit the prongs 62 to be squeezed together to friction fit in narrow opening 70. Slot 72 further is a receiver or pincher for the line 24 and permits the slippery line 24 to be wrapped in a figure eight non-slip fashion about the two prongs 62 before the plug 32 is inserted into the golf ball 30. FIG. 3B shows the preferred embodiment of the rivet 32 where the barb or lock 64 tapers or is rounded, via rounded or tapering surface 77, from the catch 74 to the end 76.

Narrow inner opening 70 is cylindrical in shape and bounded by an endless sidewall 78 formed in the inner layer 52 of golf ball 30. Narrow opening 70 widens into a wider outer opening 80. Wider opening 80 is cylindrical in shape and is bounded by an endless sidewall 82 formed in the outer layer 54 of the golf ball 30. Wider opening 80 is further defined by a floor 84 and narrow opening 70 is defined by a floor 86. Narrow opening 70 and wider opening 80 may as a whole be referred to as opening 88.

When rivet 32 is engaged in opening 88, the underside 65 of the head 56 rests on floor 84 and the outer hemispherical outer surface 58 of the head 56 is aligned with and follows the circumference of the golf ball 30 such that, if the rivet 32 or a portion thereof is hit with the putting head 18, the golf ball 30 will behave similar to a hit on outer layer 54. Further, such a force is transmitted over the relatively wide floor 84 and into the golf ball 30. The rivet head perimeter 60 is slightly smaller (i.e., has a lesser diameter) than sidewall 82 such that a fingernail or tool 120 can be inserted in the space therebetween for removal of the plug 32.

When rivet 32 is being inserted into opening 88, the prongs 62 pass through wider opening 80 and make contact with the outer edges of sidewall 78. Upon further pressure, the prongs 62 are drawn together by virtue of the tapered surfaces 68 or 77 and then friction slid into narrow opening 70 until the underside 65 of the rivet head 58 meets the floor 84 of the wider opening 80. The perimeter of the barbs 64 as a whole, when the prongs 62 are unengaged and outside of golf ball 30, is slightly greater than the perimeter of sidewall 78. Rivet 32 is preferably formed of a plastic material.

As shown in FIG. 3B, opening 88 is lined with a liner 90 that is in the shape of a receptacle. Liner 90 includes an inner floor 92, an inner cylindrical sidewall 94, an outer floor 96, and an outer cylindrical sidewall 98. Liner 90 is preferably formed of a plastic material. The diameter of outer sidewall 98 is preferable slightly greater than the diameter 60 of rivet head 56. The diameter of inner sidewall 94 is preferably slightly less than a diameter of the prongs 62 as a whole such that the prongs 62 are squeezed together resiliently when the rivet 32 is inserted into the liner 90. With a liner 90, the engagement between rivet 32 and the golf ball 32 can be Controlled such that the rivet 32 can be relatively easily removed or relatively difficult to remove.

The line 24 that engages the golf ball 30 to the golf club 12 is preferably a fishing line. A fishing line or the body of the fishing line includes or is formed from nylon, polyester, aliphatic polyester biodegradable plastics, nylon monofilaments, or metal. The fishing line is preferably a nylon line or a nylon monofilament line. As to the line, the following U.S. Patents are hereby incorporated by reference: 1) the Cunningham et al. U.S. Pat. No. 5,573,850 issued Nov. 12, 1996, entitled Abrasion Resistance Quasi Monofilament And Sheathing Compositions and assigned to AlliedSignal Inc.; 2) the Koike U.S. Pat. No. 5,753,366 issued May 19, 1998, entitled Fishing Line and assigned to Daiwa Seiko, Inc.; and 3) the Abiru et al. U.S. Pat. No. 5,881,492 issued Mar. 16, 1999, entitling Fishing Line and assigned to toy Boseki Kabushiki Kaisha.

In manufacture, shaft 16 is first cut to length. Then the grip 16 is engaged to the shaft 16. Then the three shrink wrap tubes 26 are slid onto the shaft 16. Then the club head 18 is engaged to the shaft 16. Then the reel 20 is fixed in place using the hot air gun to shrink wrap the pair of tubes 26 about the feet of the T-base 22. Then the eyelet 28 is positioned where desired on the shaft 16, usually in an offset position so as to be located on a straight line between spool opening 48 and a location in front of the face of the club head 18.

Once the eyelet 28 is properly positioned, the eyelet 28 is glued to such position and then set fast to such position by slipping the remaining tube 26 over the eyelet base 46 and heating the tube 26 to shrink wrap the tube 26. Then the button lock 38 is depressed to release the line 24, which is drawn through the eyelet 28. A distal end portion of the line 24 is then wrapped about the prongs 62, such as in a figure eight pattern, and the rivet 32 is inserted into the opening 88. The apparatus 10 is thus operational such that the golf ball 30 can be hit and then retrieved by the reel 20.

Figure 5A:
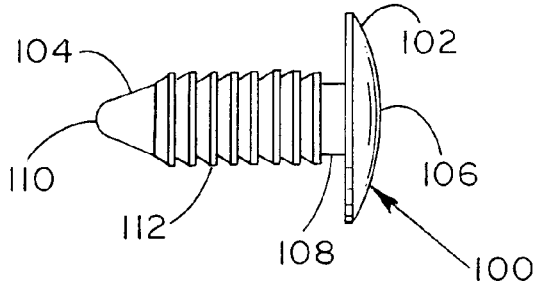
FIG. 5A is a side view of the preferred embodiment of the rivet of the present invention.

As shown in FIG. 5A, a preferred rivet 100 includes a head or proximal end portion 102 and a shaft or distal end portion 104. Head 102 includes an outer surface 106 having the curvature of a conventional golf ball such that, when a club head of a golf club strikes the outer surface 106, any loss of a natural feel (through the club to the user's hands) is minimized and any loss of a natural resultant action of the golf ball is minimized. Shaft 104 includes a proximal end 108 integral and one-piece with a central inner surface of head 102 and a tapered distal end 110. Between the ends is a set of overlapping fins or pinchers or catches or locks 112 extending outwardly and in a direction from the distal end 110 to the proximal end 108. Each of the fins or pinchers extends slightly less than 180 degrees about the shaft 104 such that, effectively, there are two axially extending rows of fins or pincher 112. A diameter of width of fins or pinchers 112 is slightly greater than a diameter or width of opening 70 such that, when shaft 104 is inserted into opening 70, the fins or pinchers 112 bend resiliently and inwardly toward an axis of the shaft 104 and toward the proximal end 108. When the fins or pinchers 112 bend in such a manner, adjacent fins or pinchers abut one another and pinch therebetween matter that may be disposed therebetween, such as fishing line 24, which is wrapped about the fins or pinchers 112 prior to the rivet 100 being inserted into the golf ball 30. It should be noted that fins or pinchers 112 are also locks that lock the rivet 100 into the ball 30 and that provide for resistance when an attempt is made to remove the rivet 100 from the golf ball 30.

Figure 5B:
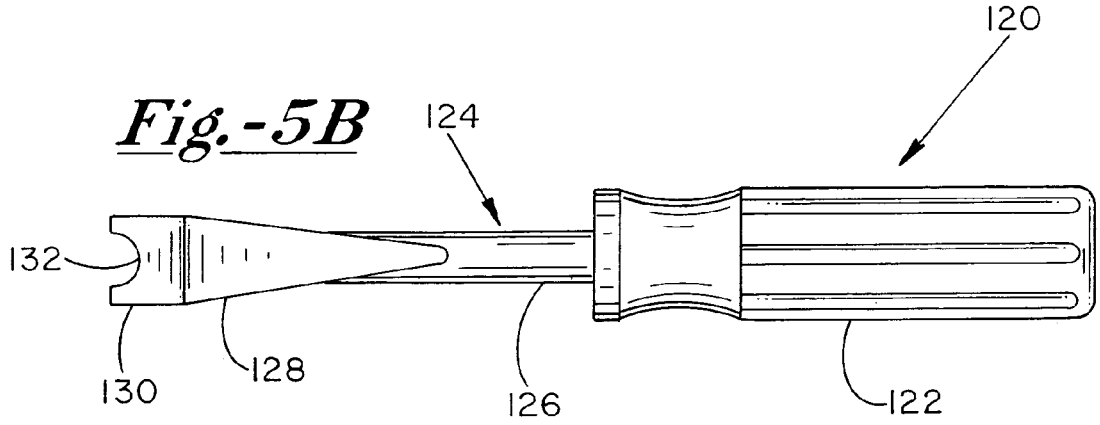
FIG. 5B is a side view of a tool of the present invention used to remove the rivet of the present invention.
Figure 5C:
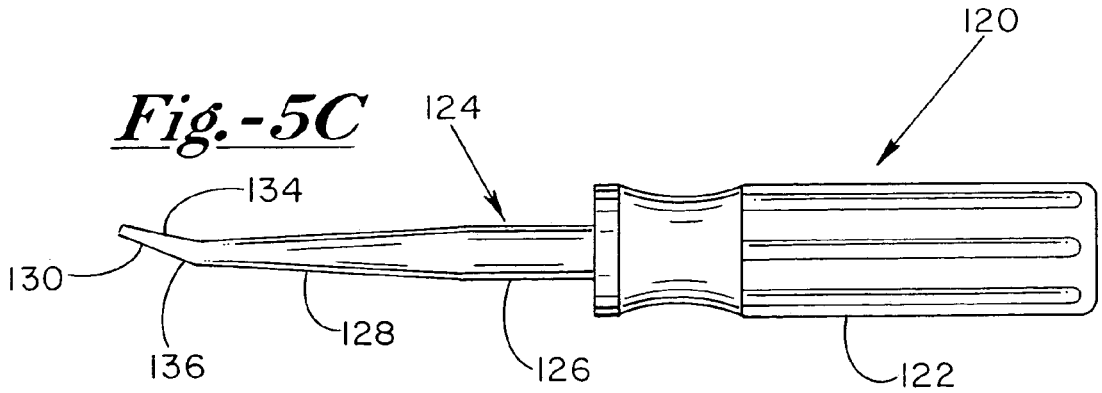
FIG. 5C is a side view of the tool of FIG. 5B rotated ninety degrees from the position shown in FIG. 5B.

FIGS. 5B and 5C show a tool 120 that may be used to remove rivet 100 from the golf ball 30. Tool 120 includes a handle 122 and a shaft 124. Shaft 124 includes a cylindrical portion 126 that leads into a tapered portion 128 that further leads into a tapered distal end 130, which in turn includes a C-shaped indent 132. Tapered portion 128 is tapered in several ways. First, as shown in FIG. 5B, tapered position 128 tapers to a width beyond the width of cylindrical portion 126. Second, as shown in FIG. 5C, tapered portion 128 tapers inwardly to a width less than the width of cylindrical portion 126. Distal end 130 includes a width greater than the width of the cylindrical portion 126 when viewed from the position shown in FIG. 5B and further includes a width less than the width of the cylindrical portion 126 when viewed from the position shown in FIG. 5C. Distal end portion 130 is itself tapered, as shown in FIG. 5C, so as to dig underneath the head 102 of rivet 100 when rivet 100 is in the golf ball 30. Each of the faces 134, 136 is set obliquely relative to an axis of cylindrical portion 126 to better position the tool 120 for leverage for prying rivet 100 from golf ball 30. Distal end portion 130 includes the C-shaped indent 132 to engage proximal end 108 of shaft 104 so as to maximize the surface area of upper surface 134 working upon the underside of the head 102 of rivet 100. It should be noted that the present apparatus 10 can be broken down and sold in a kit form that is more easily carried, shipped, and stored. For example, each of the grip 14 and club head 18 may attach to the shaft 16 via a quick connect mechanism. Or the shaft 16 itself may be split and then reengaged via a quick connect mechanism. Such a kit may include one or more club heads 18, with the club heads 18 being one or more of a putter head, chipping head, wedge head, or driver head. Such a kit may include one or more of right-handed and left-handed club heads 18. Such a kit may include one or more of right-handed and left-handed reels 20. The preferred quick connect mechanism is a screwless mechanism as threads tend to wear out over time, leading to a misalignment of the club head 18 or a misalignment of the grip 14.

Reel 20 is preferably a closed face reel. However, if desired, a reel with an open face may be used.

What is claimed is:

1. A golf ball and line apparatus, comprising:

a) a line;

b) a golf ball having a cover and a core;

c) an opening formed in at least the cover of the golf ball, with the opening having a first perimeter; and d) a plug for engaging the line to the golf ball, with the plug comprising a distal end portion for engaging at least one of the cover and core of the golf ball to keep the plug in the golf ball, with distal end portion having a diameter, when unengaged in the opening, slightly larger than a diameter of the opening such that the distal end portion frictionally engages the golf ball, said distal end portion including a pair of prongs separated by a slot, wherein the prongs are squeezed together when the plug is inserted into the prong opening.

2. The golf ball and line apparatus of claim 1, wherein the distal end portion includes a catch to create resistance between the plug and the ball when an attempt is made to pull the plug out of the ball.

3. The golf ball and line apparatus of claim 2, wherein the distal end portion includes a pincher for pinching the line therein.

4. The golf ball and line apparatus of claim 1, wherein the plug includes a head, wherein the head of the plug includes an outer surface, with the outer surface including a radius of curvature, and with the radius of curvature of the outer surface being about a radius of curvature of the golf ball.

5. The golf ball and line apparatus of claim 1, wherein the plug includes a proximal end portion having a head, wherein the distal end portion includes a row of fins, with the fins extending outwardly and toward the proximal end portion, and with some of the fins being bendable upon other fins when said some of the fins are bent toward the proximal end portion so as to pinch the line therebetween.

6. A golf ball and line apparatus, comprising:

a) a line;

b) a golf ball having a cover and a core;

c) an opening formed in at least the cover of the golf ball, with the opening having a first perimeter; and d) a plug for engaging the line to the golf ball, with the plug comprising a distal end portion for engaging at least one of the cover and core of the golf ball to keep the plug in the golf ball, with the plug further comprising a proximal end having a head, with the head having a second perimeter, with a size of the second perimeter of the head being less than a size of the first perimeter of the opening such that a space exists between the plug and the golf ball for insertion of a fingernail for removing the plug;

e) such that the line is engaged to the golf ball by pinching the line between the golf ball and the plug when the plug is inserted into the golf ball, and whereby the line is disengaged from the golf ball by prying the plug out of the opening by inserting a fingernail between the golf ball and the plug and underneath the head of the plug.

7. The golf ball and line apparatus of claim 6, wherein the head of the plug includes an outer surface, with the outer surface including a radius of curvature, and with the radius of curvature of the outer surface being about a radius of curvature of the golf ball.

8. The golf ball and line apparatus of claim 6, wherein the head of the plug includes an outer surface, with the outer surface being generally aligned with and flowing in the same direction as an outer surface of the golf ball when the plug is in the golf ball.

9. The golf ball and line apparatus of claim 6, with the distal end portion of the plug comprising a pincher for pinching the line therein, and with the pincher becoming operational when the distal end portion is inserted into the opening.

10. The golf ball and line apparatus of claim 6, wherein the distal end portion of the plug comprises a slot, with the slot having an open end, with the distal end portion being squeezed and with the slot becoming more narrow when the plug is engaged in the opening.

11. A golf club and reel apparatus, comprising:

a) a golf club having a handle, a shaft and a head for striking a golf ball;

b) a reel on the golf club, with the reel comprising a base having a foot; and c) a first one-piece and integral band about the foot and the club, with the one-piece and integral band pulling the foot fast upon the golf club, and, prior to being engaged on the foot and club, changing in diameter in response to heat;

d) such that movement between the golf club and reel is minimized whether the golf club is swung gently with a putter motion or powerfully, quickly and suddenly with a driving motion.

12. The golf club and reel apparatus of claim 11, with the base having another foot, with the feet extending in generally opposite directions, and further comprising a second one-piece and integral band about the other of the feet and the club.

13. The golf club and reel apparatus of claim 11, wherein the one-piece and integral band engages at least one of the handle and shaft.

14. The golf club and reel apparatus of claim 11, wherein the band shrinks in response to heat.

15. A golf club, ball, reel and line apparatus, comprising:

a) a line;

b) a golf ball having a plug with a diameter, a cover, a core and an opening formed in at least the cover of the golf ball, with the opening having a first perimeter and a second perimeter, with the plug engaging the line to the golf ball, with the plug comprising a distal end portion with a diameter, with the plug engaging at least one of the cover and core of the golf ball to keep the plug in the golf ball, with the diameter of the distal end portion of the plug being slightly greater than the second perimeter of the opening such the distal end portion frictionally engages the opening at the second perimeter, with the plug further comprising a proximal end having a head, with the head having a perimeter, with a size of the perimeter of the head being slightly less than a size of the opening at the first perimeter such that a space exists between the head of the plug and the golf ball for insertion of at least one of a fingernail and tool for removing the plug, such that the line is engaged to the golf ball by pinching the line between the golf ball and the plug when the plug is inserted into the golf ball, and whereby the line is disengaged from the golf ball by prying the plug out of the opening by inserting a fingernail between the golf ball and the plug and underneath the head of the plug;

c) a golf club, with the golf club having a handle, a shaft and a head for striking a golf ball; and d) a reel on the golf club, with the reel comprising a base having a foot, with the foot being held fast upon the golf club with a one-piece and integral shrink wrap tube about the foot and the golf club, and with the line extending from the reel.

* * * * *